United States Patent [19]

Otsuka et al.

[11] Patent Number: 4,691,674

[45] Date of Patent: Sep. 8, 1987

[54] MULTISTAGE FUEL INJECTION SYSTEM FOR INTERNAL COMBUSTION ENGINES

[75] Inventors: Shojiro Otsuka; Hideaki Komada, both of Higashi-Matsuyama, Japan

[73] Assignee: Diesel Kiki Co., Ltd., Tokyo, Japan

[21] Appl. No.: 783,918

[22] Filed: Oct. 3, 1985

[30] Foreign Application Priority Data

Oct. 13, 1984 [JP] Japan ..... 59-215021
Oct. 15, 1984 [JP] Japan ..... 59-215839

[51] Int. Cl.[4] ..... F02M 43/00

[52] U.S. Cl. ..... 123/299; 123/304; 123/447; 239/533.4

[58] Field of Search ..... 123/304, 299, 300, 445, 123/447, 472, 575; 239/533.4, 533.3, 533.5, 533.9

[56] References Cited

U.S. PATENT DOCUMENTS 4,022,165 5/1977 Eckert et al. ..... 123/300
4,459,959 7/1984 Terada et al. ..... 123/447
4,481,921 11/1984 Tsukahara et al. ..... 123/304

FOREIGN PATENT DOCUMENTS 969853 7/1958 Fed. Rep. of Germany ..... 123/300
2656276 6/1978 Fed. Rep. of Germany ..... 123/299
58-48771 3/1983 Japan ..... 123/575

*Primary Examiner*—Andrew M. Dolinar
*Attorney, Agent, or Firm*—Wenderoth, Lind & Ponack

[57] ABSTRACT

A multistage fuel injection system for an internal combustion engine has an injection nozzle capable of injecting main and auxiliary fuels into a cylinder of the engine at controlled intervals, thereby completely combusting an unburned fuel-and-air mixture in the cylinder. The injection nozzle includes a main injection passage for the main fuel, a needle valve for opening and closing the main injection passage, an auxiliary injection passage for the auxiliary fuel communicating with the main injection passage through the needle valve at a discharge end of the latter, and a check valve for preventing a reverse flow of the main fuel from the main injection passage to the auxiliary injection passage.

9 Claims, 10 Drawing Figures

MULTISTAGE FUEL INJECTION SYSTEM FOR INTERNAL COMBUSTION ENGINES

BACKGROUND OF THE INVENTION

1. Field of the Invention

This invention relates to a multistage fuel injection system for injecting fuels of different kinds into cylinders of an internal combustion engine such as a marine diesel engine.

2. Prior Art

Japanese Patent Laid-open Publication No. 58-77160 discloses a high pressure fuel injection system in which a controlled amount of fuel is introduced into an intensifier or booster where fuel is increased in pressure by a working fluid supplied to the booster and then it is supplied to an injection nozzle, the supply of working fluid being adjusted by a solenoid valve for automatically controlling the fuel injection timing.

According to another fuel injection system disclosed in Japanese Patent Laid-open Publication No. 50-119130, immediately after the injection of a main fuel such as diesel fuel oil, an auxiliary fuel such as water is injected into engine cylinders so as to completely burn an unburned or excessively thick fuel-and-air mixture, thereby increasing the heat generating efficiency of the cylinders. The main fuel is supplied by a fuel injection pump to a distributor for driving plungers thereof to thereby distribute the main and auxiliary fuels respectively to a pair of main and auxiliary injection nozzles at different timings, thus effecting a multistage fuel injection.

It is easy to obtain a multistage high pressure fuel injection system by combining the teachings of the above-mentioned publications. The resultant fuel injection system is however still unsatisfactory in that since two injection nozzles must be installed in a cylinder head of each cylinder, it is difficult to achieve a proper orientation of such injection nozzles the lack of such a proper orientation would result in an inaccurately controlled fuel injection and a low heat generating efficiency of the engine cylinder.

SUMMARY OF THE INVENTION

It is accordingly a general object of the present invention to provide a high pressure multistage fuel injection system for an internal combustion engine, the system having structural features which are capable of overcoming the aforementioned drawbacks of the prior fuel injection systems.

A more specific object of the present invention is to provide a high presure multistage fuel injection system having a single injection nozzle which occupies only a small space in an engine cylinder head and hence can be orientated properly to assure an accurately controlled fuel injection and which achieves a multistage fuel injection thereby providing an increased heat generating efficiency.

According to the present invention, the foregoing and other objects are attained by a multistage fuel injection system for an internal combustion engine, the system comprising: flow control means for feeding a controlled quantity of main fuel and a controlled quantity of auxiliary fuel independently from one another; pressure generating means for generating a working pressure; intensifying means connected to said flow control means and said pressure generating means for intensifying the pressure of the main and auxiliary fuels received from said flow control means, through the agency of said working pressure generated by said pressure generating means; selector means interposed between said pressure generating means and said intensifying means for selectively connecting and disconnecting them; control means connected to said selector means and responsive to engine operating conditions for controlling operation of said selector means; and an injection nozzle connected to said intensifying means for injecting the main fuel and the auxiliary fuel respectively into an engine cylinder, said injection nozzle including a main injection passage for the main fuel, a needle valve for opening and closing said main injection passage, an auxiliary injection passage for the auxiliary fuel communicating with said main injection passage through said needle valve at a discharge end of the latter, and a check valve for preventing the reverse flow of the main fuel from said main injection passage to said auxiliary injection passage.

The main and auxiliary fuels which have been fed from the flow control means to the intensifying means are injected from the injection nozzle at respective times determined by the control means. When the fuel pressure in the main injection passage is increased, the needle valve is raised to open the main injection passage to effect a first stage of fuel injection, at which instance the check valve blocks the reverse flow of main fuel from the main injection passage to the auxiliary injection passage. When the fuel pressure in the auxiliary injection passage is increased, the check valve is raised to open the auxiliary injection passage to achieve a second stage of fuel injection. Thus, though only a single injection nozzle is provided, and such an injection nozzle is capable of effecting a multistage fuel injection.

Many other advantages and features of the present invention will become manifest to those versed in the art upon making reference to the detailed description and the accompanying sheets of drawings in which preferred structural embodiments incorporating the principles of the present invention are shown by way of illustrative example. Like reference characters designate the same or similar parts throughout the drawings.

DETAILED DESCRIPTION

Figure 1:
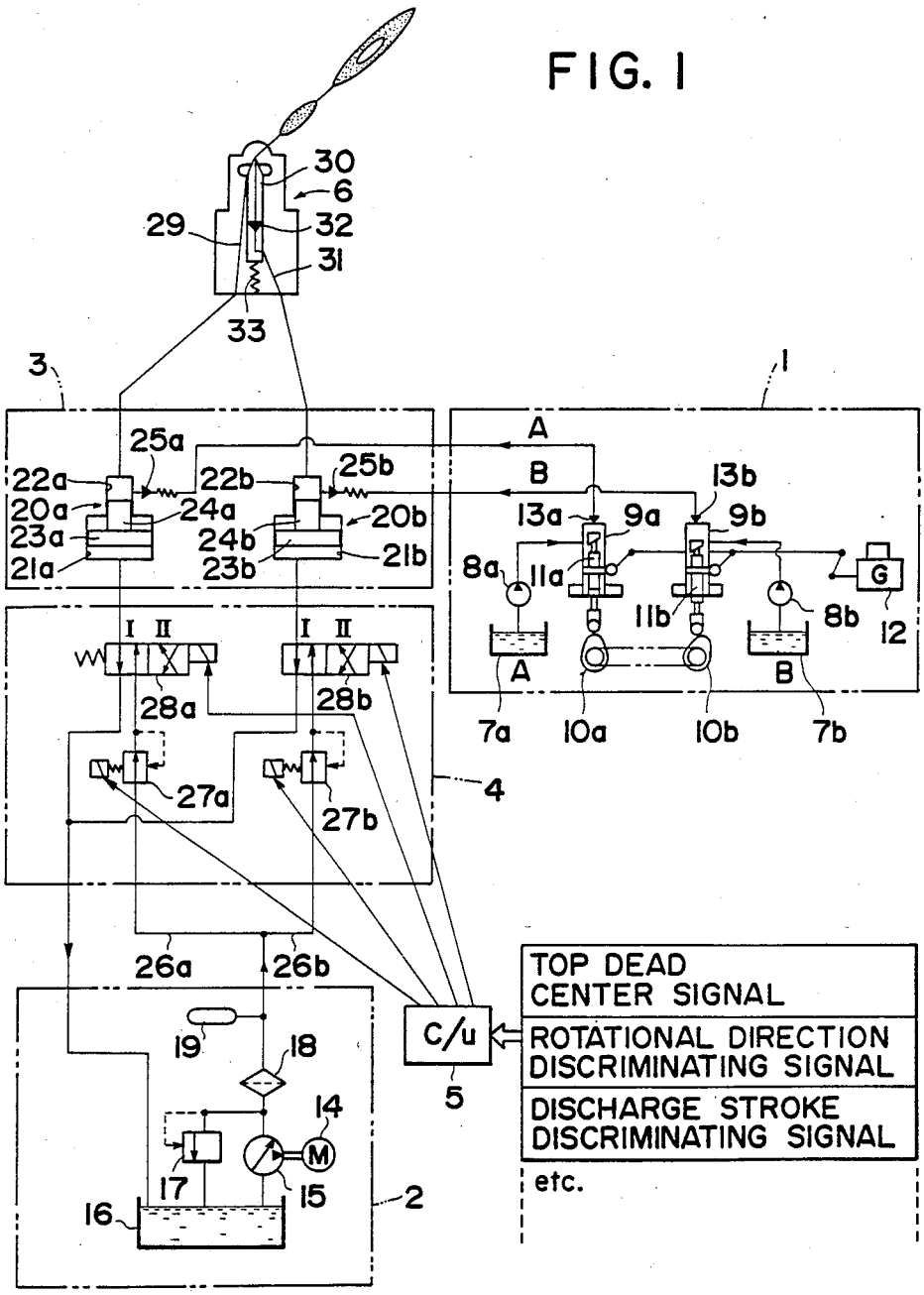
FIG. 1 is a diagrammatic view of a multistage fuel injection system embodying the present invention.

The principles of the present invention are particularly useful when embodied in a multistage fuel injection system such as that shown in FIG. 1.

The multistage fuel injection system generally comprises a flow control means 1, a pressure generating means 2, an intensifying means 3, a selector means or direction control means 4, a control means 5 and an injection nozzle 6.

The flow control means 1 includes a main fuel tank 7*a* for reserving a main fuel A such as diesel fuel oil, and an auxiliary fuel tank 7b for reserving an auxiliary fuel B such as water. The main and auxiliary fuel tanks 7a, 7b communicate respectively through feed pumps 8a, 8b with flow control pumps 9a, 9b. The flow control pumps 9a, 9b include cams 10a, 10b driven to rotate in synchronism by the crankshaft of an internal combustion engine (not shown) for reciprocating plungers 11a, 11b, and a governor 12 for adjusting the effective strokes of the respective plungers. A controlled quantity of main fuel A and a controlled quantity of auxiliary fuel B are fed from the respective flow control pumps 9a, 9b through feed valves 13a, 13b to the intensifying means 3.

The pressrue generating means 2 includes a working fluid pump 15 driven by a motor 14 to suck a working fluid from a working fluid tank 16 and to force the working fluid downstream to a releaf valve 17 and also to a filter 18. The relief valve 17 serves to limit the maximum pressure of the working fluid and the filter 18 serves to eliminate foreign matters from the working fluid. The working fluid which has passed through the filter 18 is stored in an accumulator 19 and then is supplied therefrom to the intensifying means 3.

The intensifying means 3 is composed of two intensifiers or boosters 20a, 20b which are structurally identical with each other. Each of the intensifiers 20a, 20b includes a large-diameter bore 21a, 21b, a small-diameter bore 22a, 22b extending coaxially with the bore 21a, 21b, a large-diameter piston 23a, 23b slidably disposed in the large-diameter bore 21a, 21b and a small-diameter piston 24a, 24b slidably disposed in the small-diameter bore 22a, 22b, the pistons 23a, 23b and 24a, 24b being connected together. The large-diameter bores 21a, 21b are connected through the selector means 4 to the pressure generating means 2. The small-diameter bores 22a, 22b are connected respectively to the outlets of the flow control pumps 9a, 9b in the flow control means 1 and also to the nozzle 6. A pair of check valves 25a, 25b is disposed in the inlets of the respective small-diameter bores 22a, 22b which communicate with the corresponding flow control pumps 9a, 9b. With this construction, when the working fluid is supplied from the pressure generating means 2 through the selector means 4 to the large-diameter bores 21a, 21b, the large-diameter pistons 23a, 23b and the small-diameter pistons 24a, 24b are moved upwardly (FIG. 1) in unison to thereby increase the pressure of the main and auxiliary fuels A, B contained in the respective small-diameter bores 22a, 22b. The fuels A, B of increased pressure are then supplied to the injection nozzle 6. When the working fluid is returned by the selector means 4 from the large-diameter bores 21a, 21b to the tank 16 of the pressure generating means 2, the pressure in the bores 21a, 21b is decreased to cause the large-diameter pistons 23a, 23b and the small-diameter pistons 24a, 24b to move downwardly. The main and auxiliary fuels A, B are supplied from the respective flow control pumps 9a, 9b of the flow control means 1 to the small-diameter bores 22a, 22b.

The selector means 4 includes a pair of working fluid supply lines 26a, 26b connected in parallel to the pressure generating means 2, and two pairs of solenoid controlled proportional pressure reducing valves 27a, 27b and solenoid operated directional control valves 28a, 28b disposed in series in the respective working fluid supply lines 26a, 26b. The pressure reducing valves 27a, 27b regulate the pressure of working fluid in response to output signals delivered from the control means 5. Likewise, the directional control valves 28a, 28b select the direction of working fluid in response to the output signals delivered from the control means 5. Each of the directional control valves 28a, 28b has a first valve position I in which the working fluid is returned from the large-diameter bores 21a, 21b to the working fluid tank 16, and a second valve position II in which the working fluid is supplied from the tank 16 to the large-diameter bores 21a, 21b.

The control means 5 is so constructed as to first receive various input signals indicative of engine operating conditions, such as a top dead center signal, a rotational direction discriminating signal, a discharge stroke discriminating signal, etc., then to process the input signals through comparison, computation and amplification for obtaining output signals, and finally to send the output signals to the pressure reducing valves 27a, 27b and the directional control valves 28a, 28b.

The injection nozzle 6 includes a main injection passage 29, a needle valve 30 for opening and closing the main injection passage 29, an auxiliary injection passage 31 communicating through the needle valve 30 with the main injection passage 29 at a discharge end of the latter, and a check valve 32 for preventing the reverse flow of fuel from the main injection passage 29 to the auxiliary injection passage 31. The needle valve 30 is biased by a compression spring 33 to normally close the main injection passage 29.

Figure 2:
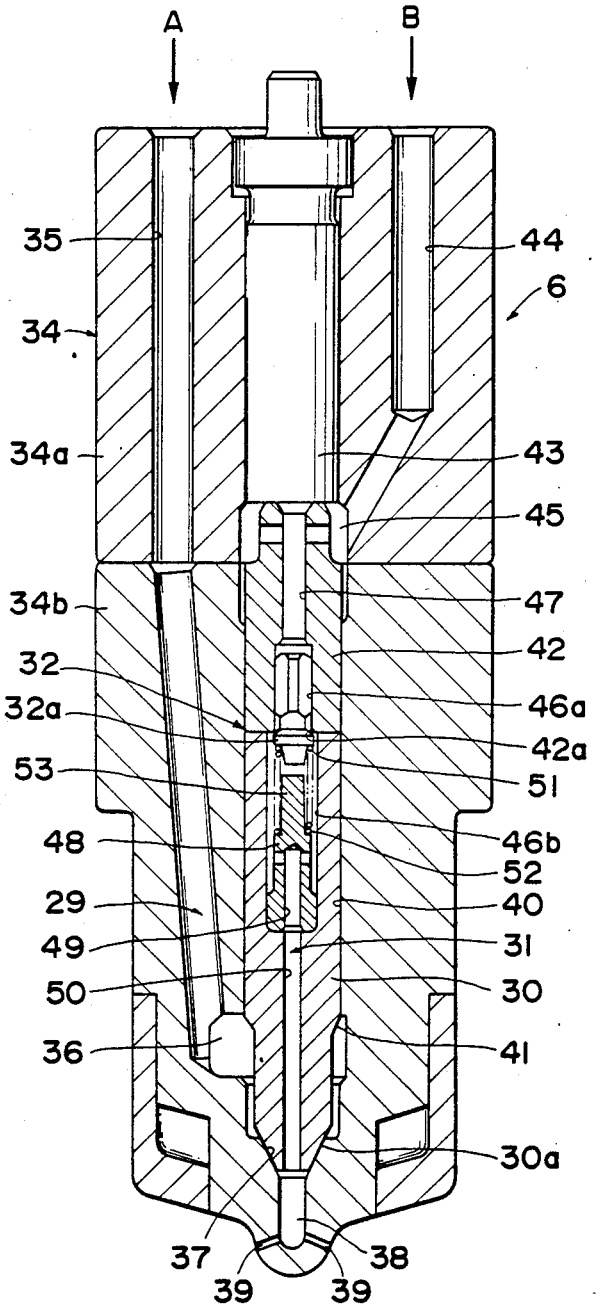
FIG. 2 is an enlarged longitudinal cross-sectional view of an injection nozzle employed in the fuel injection system shown in FIG. 1.

More specifically, as shown in FIG. 2, the injection nozzle 6 includes a nozzle body 34 composed of an upper body member 34a and a lower body member 34b that are connected together, the nozzle body being adapted to be mounted in a cylinder head of the engine (not shown). The nozzle body 34 includes defined therein an axial main inlet hole 35 opening at one end to an upper surface of the upper body member 34a for receiving the main fuel A delivered from the flow control pump 9a, the other end of the main inlet hole 35 communicating with an annular fuel collecting chamber 36 defined in the lower body member 34b. The main fuel collecting chamber 36 includes at its lower portion an upwardly flared valve seat 37. The nozzle body 34 further includes an axial outlet chamber 38 contiguous to the valve seat 37 and a plurality of injection holes or apertures 39 extending radially outwardly from the outlet chamber 38 at a predetermined angle to the longitudinal central axis of the nozzle body 34. The main injection passage 29 is constituted jointly by the main inlet hole 35, the main fuel collecting chamber 36, the outlet chamber 38 and the injection apertures 39.

The nozzle body 34 also includes a central axial bore 40 extending from the upper surface of the upper body member 34a to the main fuel collecting chamber 36. The needle valve 30 is slidably disposed in a lower portion of the central axial bore 40 and has a tapered lower edge 30a having a contour complementary to that of the valve seats 37 for mutual engagement and disengagement with the latter to open and close the main injection passage 29. The needle valve 30 further has a tapered pressure bearing surface 41 normally facing the fuel collecting chamber 36. The fuel pressure in the main fuel collecting chamber 36 acts upon the pressure bearing surface 41 so that when the spring pressure is overcome, the needle valve 30 is raised some distance and the main fuel A is injected into an engine cylinder (not shown) through the injection apertures 39. Disposed above the needle valve 30 is a valve seat element 42 onto which a connecting rod 43 is disposed in abutment therewith. The connecting rod 43 is urged downwardly by the compression spring (FIG. 1) to force the valve seat element 42 and the needle valve 30 downwardly until the lower edge 30*a* of the needle valve 30 is brought into mutual engagement with the valve seat 37.

The nozzle body 34 also includes an auxiliary inlet hole 44 having one end opening to the upper surface of the upper body member 34*a* for receiving the auxiliary fuel B delivered from the flow control pump 9*b*, the other end of the hole 44 communicating with an auxiliary fuel collecting chamber 45 defined substantially at the middle portion of the central bore 40. The auxiliary fuel collecting chamber 45 receives an upper portion of the valve seat element 42. A pair of coaxial circular recesses 46*a*, 46*b* extends respectively in a lower portion of the valve seat element 42 and in an upper portion of the needle valve 30 for receiving therein the check valve 32. The upper recess 46*a* communicates with the auxiliary fuel collecting chamber 45 through a first connecting groove 47. A spring retainer 48 is disposed in the lower recess 46*b* and has a second connecting groove 49. The needle valve 30 includes a third connecting groove 50 extending between the lower recess 46*b* and the outlet chamber 38 in registry with the second connecting groove 49. Thus, the lower recess 46*b* communicates with the outlet chamber 38 through the second and third connecting grooves 49, 50. The auxiliary injection passage 32 is constituted jointly by the auxiliary inlet hole 44, the auxiliary fuel collecting chamber 45, the check valve receiving recesses 46*a*, 46*b*, the first through third connecting grooves 47, 49, 50 the outlet chamber 38, and the injection apertures 39.

The check valve 32 includes a poppet valve element 32*a* normally urged by a compression coil spring 51 against a lower end of the valve seat element 42 for closing the upper recess 46*a* of the latter, the lower end of the element 42 defining an auxiliary valve seat 42*a*. The coil spring 51 is retained on an intermediate annular shoulder 52 of the retainer 48. The retainer 48 includes an axial extension or stop 53 disposed in the coil spring 51 and extending toward the poppet valve element 32*a* but terminating short of the latter to limit the maximum stroke of the valve element 32*a*.

Figure 3:
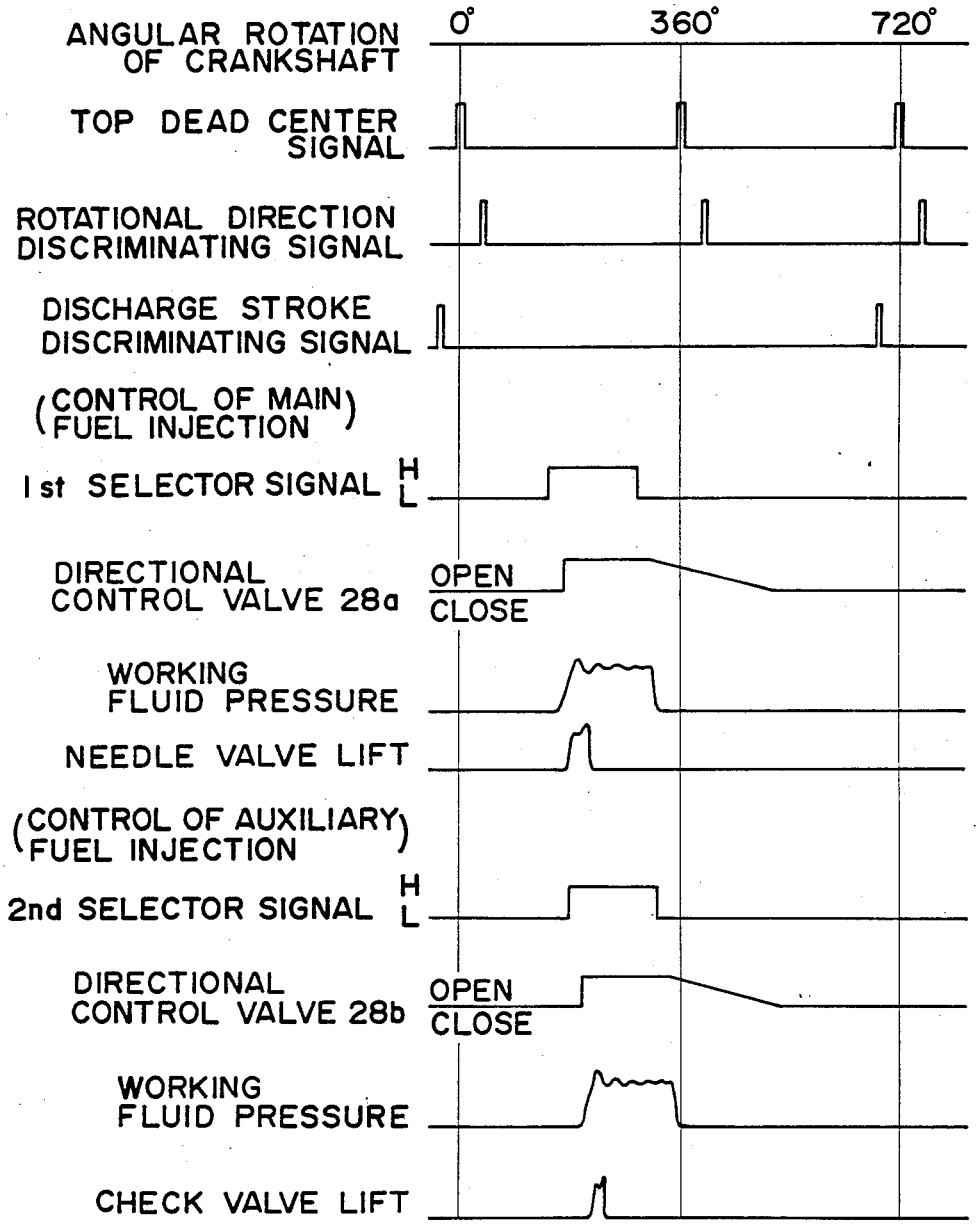
FIG. 3 is a timing chart illustrating the operation of the fuel injection system shown in FIG. 1.

Operation of the multistage fuel injection system thus constructed is described below with reference to FIGS. 1 through 3.

To the control means 5, a top dead center signal is inputted in response to a predetermined angle of rotation of the engine crankshaft for determining the timing when a cylinder arrives at the top dead center thereof. Likewise, a rotational direction discriminating signal and a discharge stroke discriminating signal are also inputted into the control means 5 for determining the direction of rotation of the engine crankshaft and the discharge stroke timing, respectively.

When the engine is operating to rotate its crankshaft in a forward direction, and when a predetermined period of time expires after completion of a discharge stroke, the control means 5 delivers a first selector pulse signal H to the directional control valve 28*a* for a predetermined period of time. The directional control valve 28*a* is rapidly opened with a slight delay from the leading edge of the first selector pulse signal H, the valve 28*a* being suddenly closed at the trailing edge of the pulse signal H. When the directional control valve 28*a* is open, the working fluid is fed from the pressure generating means 2 through the pressure reducing valve 27*a* and the directional control valve 28*a* to the large-diameter bore 21*a* of the intensifier 20*a*. As a result, the fluid pressure in the bore 21*a* increases, causing the large-diameter piston 23*a* and the small-diameter piston 24*a* to move upwardly (FIG. 1). This movement of the pistons 23*a*, 24*a* creates a rapid increase in pressure of the main fuel A contained in the small-diameter bore 22*a*, the main inlet hole 35 and the main fuel collecting chamber 36. When the fuel pressure acting on the pressure bearing surface 41 of the needle valve 30 overcomes the spring 33, the needle valve 30 is raised (FIG. 2) some distance thereby communicating the main fuel collecting chamber 36 with the outlet chamber 38. Thus, the main fuel A is injected into the non-illustrated engine cylinder through the injection apertures 39. During that time, the poppet valve element 32*a* of the check valve 32 is seated against the auxiliary valve seat 42*a* of the valve seat element 42 to block the reverse flow of the main fuel A from the main injection passage 29 to the auxiliary injection passage 31. The needle valve 30 is raised for a predetermined period depending on the controlled quantity of main fuel A which is delivered from the flow control pump 9*a* of the flow control means 1. When the directional control valve 28*a* is actuated to assume the valve position I (FIG. 1), the fuel pressure in the main inlet hole 35 decreases whereupon the needle valve 30 is urged by the spring 33 to seat against the valve seat 37, thereby closing the main injection passage 29 to terminate the main fuel injection.

The foregoing main fuel injection is followed by the auxiliary fuel injection with a slight interval therebetween. To this end, slightly after the delivery of first selector signal H, the control means 5 sends a second selector signal to the directional control valve 28*b* for a predetermined period of time. When the directional control valve 28*b* is opened, the working fluid fed from the pressure generating means 2 flows through the pressure reducing valve 27*b* and the directional control valve 28*b* into the large-diameter bore 21*b* of the intensifier 20*b*, thereby increasing the fluid pressure in the bore 21*b*. Such pressure increase causes the pistons 23*b*, 24*b* to move upwardly (FIG. 2) whereupon the pressure of auxiliary fuel B contained in the small-diameter bore 22*b*, the auxiliary fuel collecting chamber 45 and the first connecting groove 47 increases accordingly. When the fuel pressure acting on the poppet valve element 32*a* of the check valve 32 exceeds the force of the spring 51, the valve element 32*a* is released downwardly (FIG. 2) from the valve seat 42*a* thereby communicating the auxiliary fuel collecting chamber 45 with the outlet chamber 38 through the first through third connecting grooves 47, 49, 50. As a result, the auxiliary fuel B is injected into the engine cylinder through the injection apertures 39. The period of auxiliary fuel injection is determined in dependence on the controlled quantity of auxiliary fuel B. With the succession of main and auxiliary fuel injections or the multistage fuel injection thus achieved, an unburned fuel-and-air mixture is completely burned in the engine cylinder. Accordingly, the heat generating efficiency of the cylinder is considerably increased. When the directional control valve 28*b* is closed, the fuel pressure in the auxiliary inlet hole 44 decreases whereupon the poppet valve element 32*a* is urged by the spring 51 to seat against the valve seat 42 thereby terminating the auxiliary fuel injection.

Figure 4:
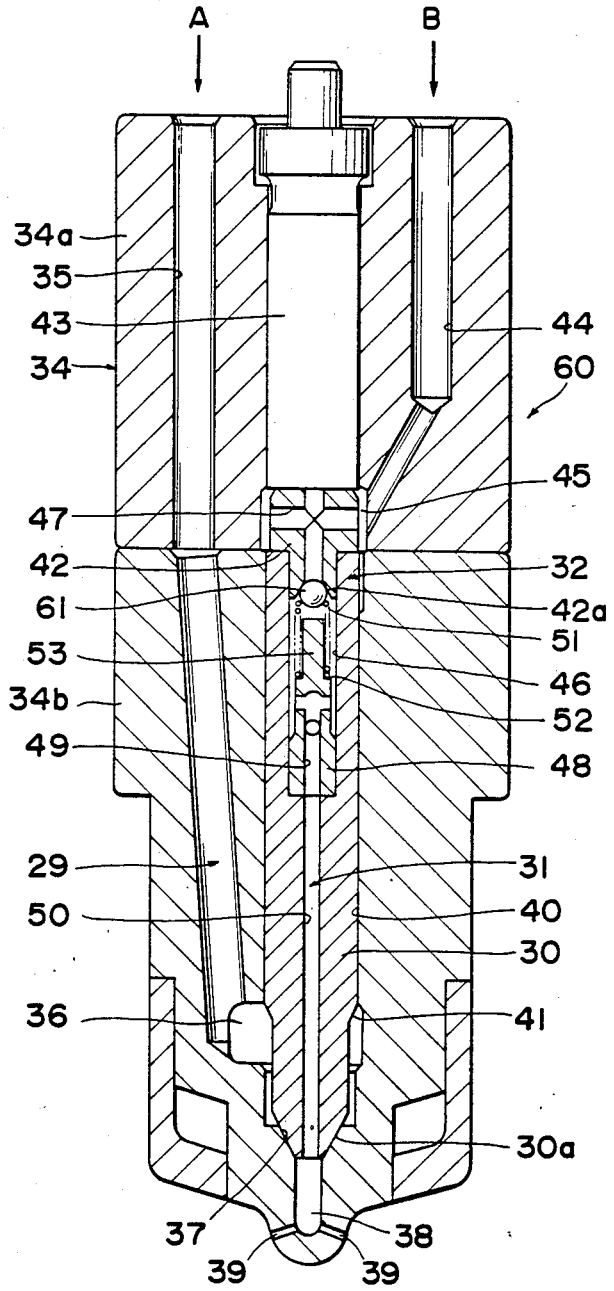
FIGS. 4 through 10 are views similar to FIG. 2 but showing several modified forms of injection nozzles provided in accordence with the present invention.

FIG. 4 shows a modified injection nozzle 60 which is substantially the same as the injection nozzle 6 of the foregoing embodiment shown in FIG. 2 but differs therefrom in that the check valve 32 comprises a ball valve element 61 and in that the valve seat element 42 has a generally T-shaped axial cross section and is composed of a flanged upper portion disposed in the auxiliary fuel collection chamber 45 and a lower small-diameter portion disposed in a check-valve receiving recess 46 in the needle valve 30.

Figure 5:
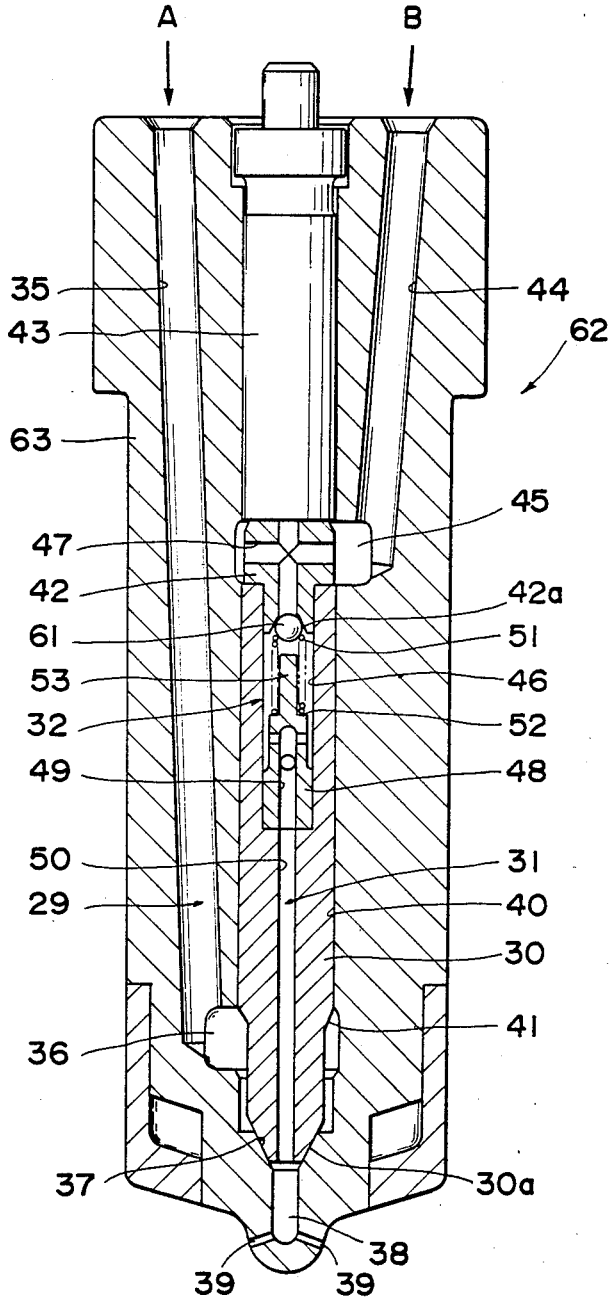
Figure 6:
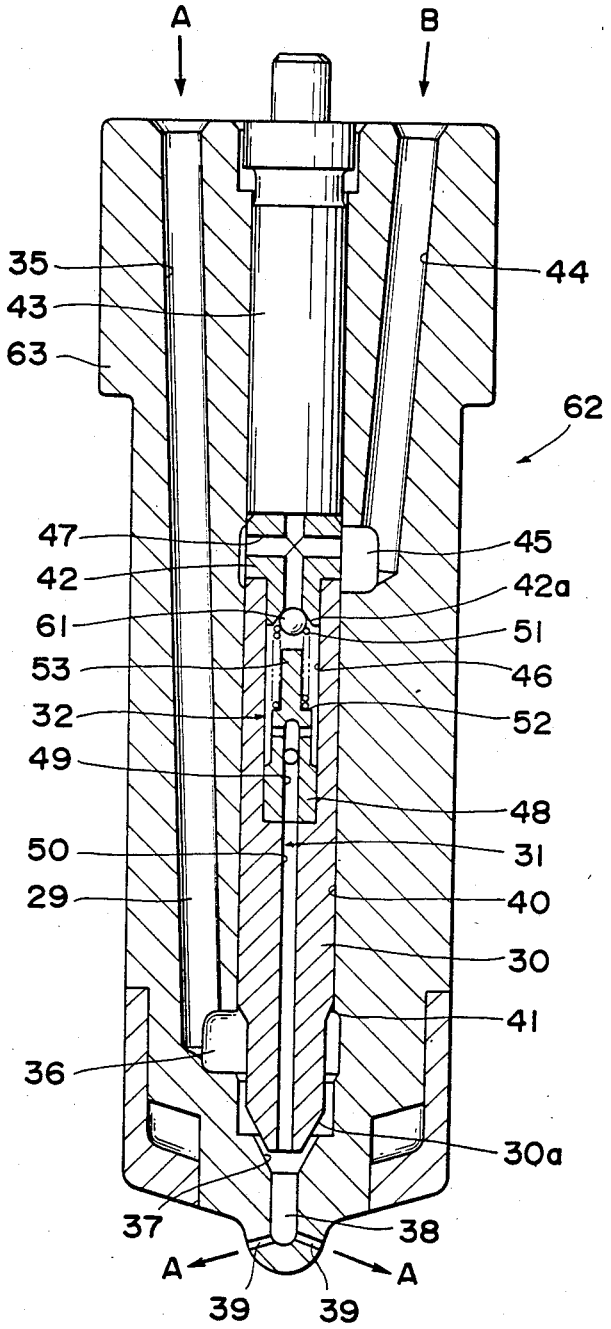
Figure 7:
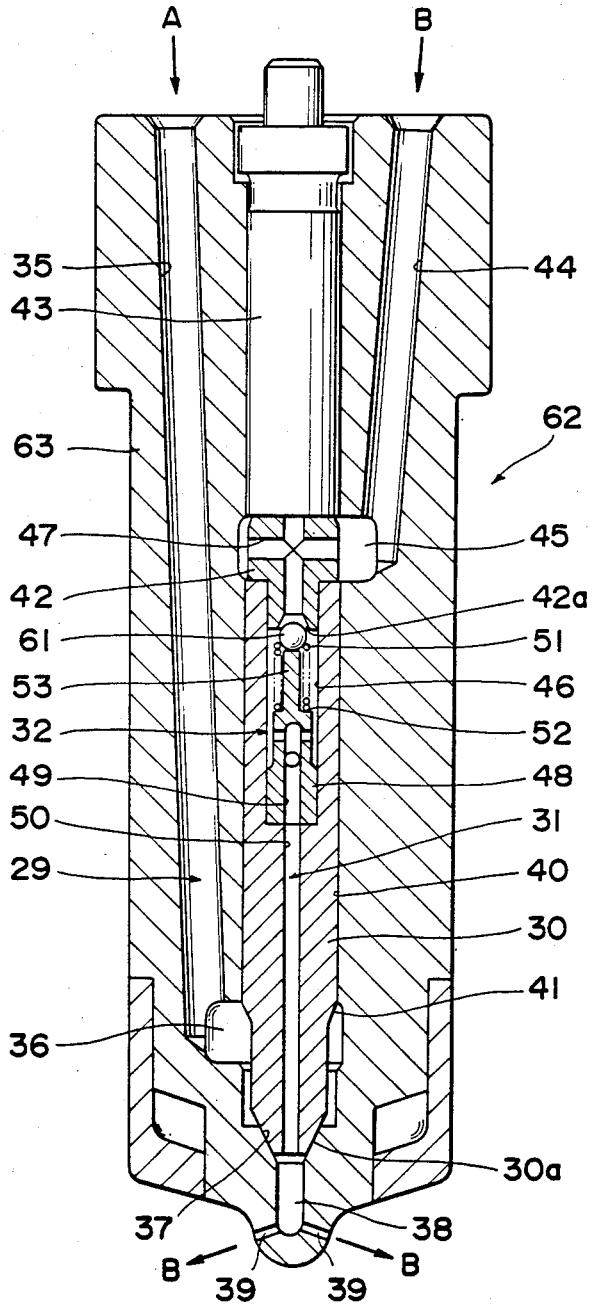

Another modified injection nozzle 62 shown in FIGS. 5 through 7 is substantially identical with the nozzle 60 shown in FIG. 4 with the exception that the nozzle 62 includes a one-piece nozzle body 63. In the condition shown in FIG. 5, fuel injection does not take place. FIG. 6 illustrates a manner in which the main fuel injection takes place whereas FIG. 7 shows a manner in which the auxiliary fuel injection takes place.

Figure 8:
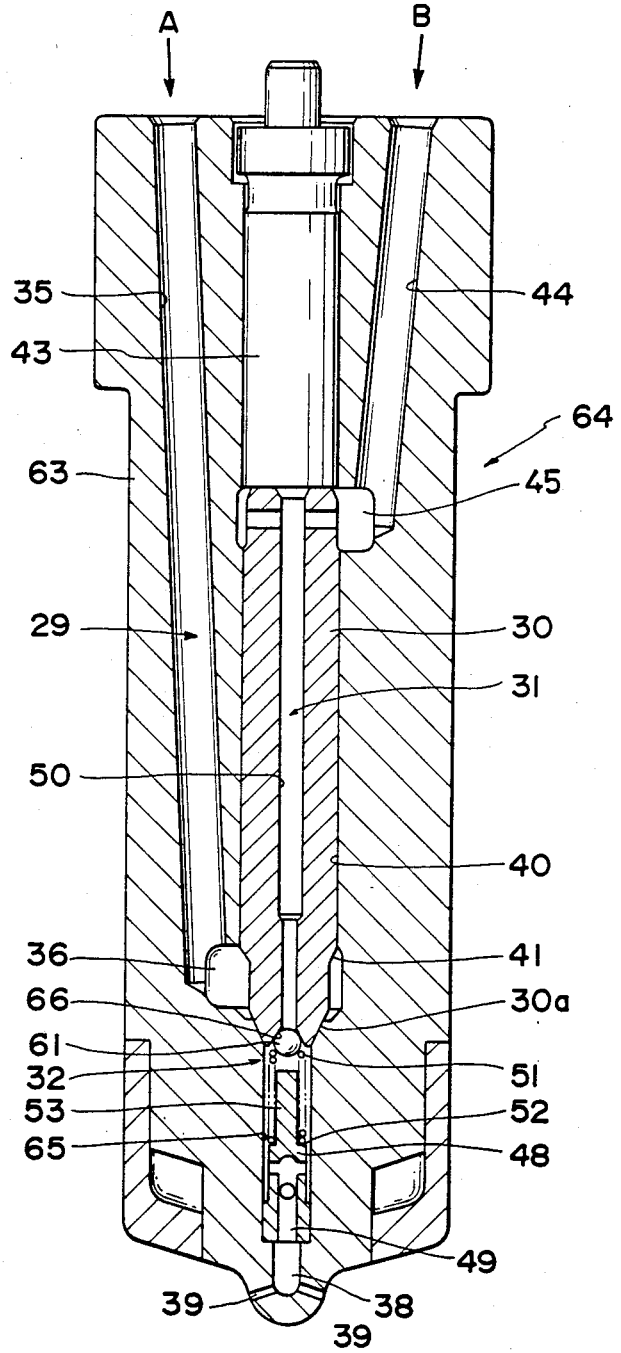

FIG. 8 shows a further modified form of the injection nozzle according to the invention. The injection nozzle 64 is structurally different from the injection nozzles 6, 60, 62 of the foregoing embodiments in that the check valve 32 is disposed at the discharge end of the needle valve 30. More specifically, the injection nozzle 64 includes a cylindrical recess 65 defined in the nozzle body 34 between the main fuel collecting chamber 36 and the outlet chamber 38 for receiving the ball valve element 61, the compression coil spring 52 and the spring retainer 48. The ball element 61 is normally urged by the spring 51 against an auxiliary valve seat 66 to close the auxiliary injection passage 31, the valve seat 66 being defined at the discharge end of the needle valve 30. In this embodiment, the valve seat element such as that shown in FIGS. 3, and 4–7 by the numeral 42*a* can be omitted and the needle valve 30 is elongated to abut against the connecting rod 43. The main injection passage 29 is constituted by the main inlet hole 35, the main fuel collecting chamber 36, the check-valve receiving recess 65, the second connecting passage 49 in the spring retainer 48, the outlet chamber 38 and the injection apertures 39. On the other hand, the auxiliary injection passage 31 is constituted by the auxiliary inlet hole 44, the auxiliary fuel collecting chamber 45, the third connecting groove 50 in the needle valve 30, the outlet chamber 38 and the injection apertures 39.

Figure 9:
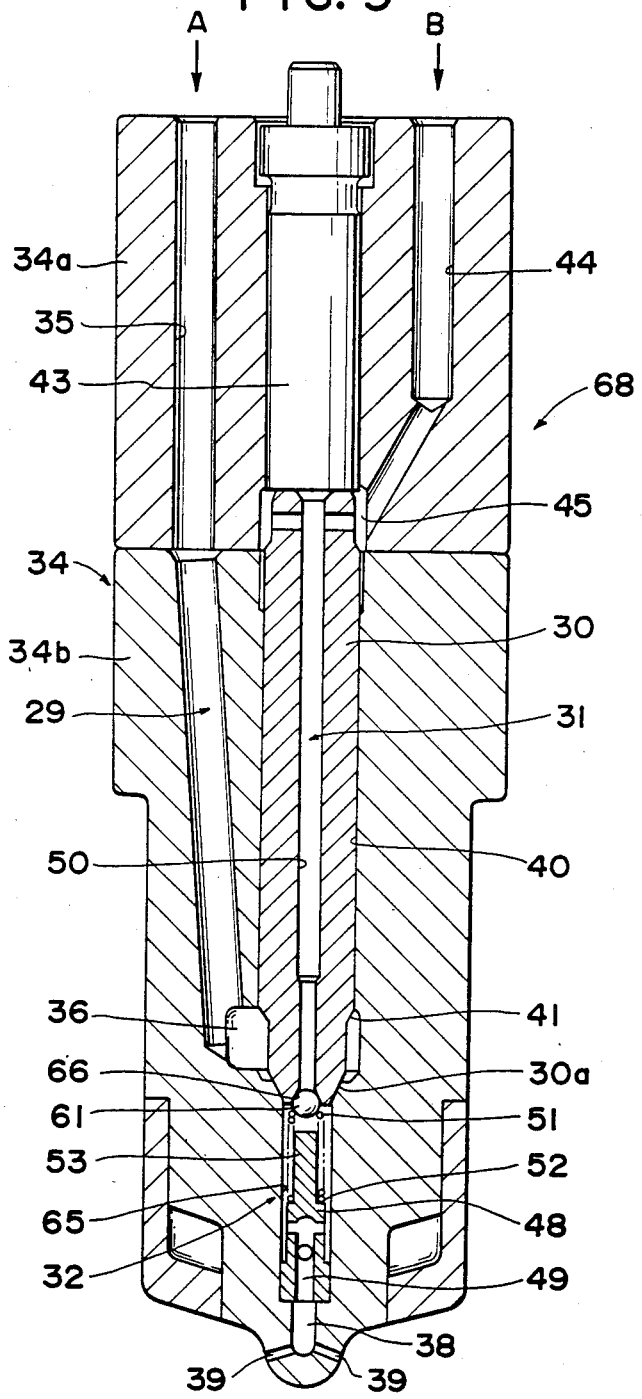

A modified injection nozzle 68 shown in FIG. 9 is substantially identical with the injection nozzle 64 of FIG. 8, except that the nozzle body 34 is composed of two members, namely upper and lower body members 34*a*, 34*b* to facilitate machining of the nozzle body 34.

Figure 10:
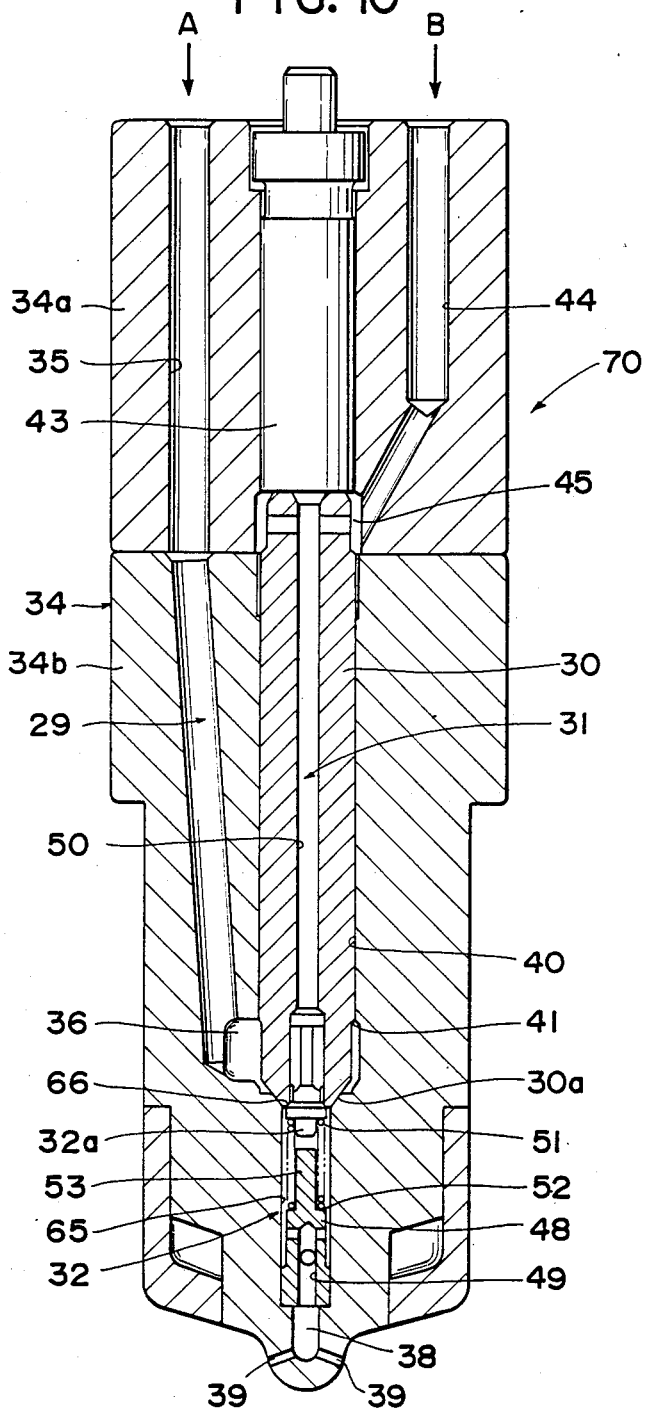

FIG. 10 shows still another modified injection nozzle 70. The nozzle 70 is the same as the nozzle 68 of FIG. 9 with the exception that the check valve 32 comprises a poppet valve element 32*a*.

Obviously, many modifications and variations of the present invention are possible in the light of the above teachings. It is therefore to be understood that within the scope of the appended claims, the invention may be practiced otherwise than as specifically described.

What is claimed is:

1. A multistage fuel injection system for an internal combustion engine, said system comprising:

(a) flow control means for feeding a controlled quantity of main fuel and a controlled quantity of auxiliary fuel independently from one another;

(b) pressure generating means for generating a working pressure;

(c) intensifying means operatively connected to said flow control means for receiving the main and auxiliary fuels therefrom and operatively connected to said pressure generating means for intensifying the pressure of the main and auxiliary fuels received from said flow control means through the agency of said working pressure generated by said pressure generating means;

(d) selector means interposed between said pressure generating means and said intensifying means for selectively connecting and disconnecting said pressure generating means and said intensifying means;

(e) control means operatively connected to said selector means and responsive to operating conditions of the engine for controlling the operation of said selector means; and (f) an injection nozzle connected to said intensifying means for injecting the main fuel and the auxiliary fuel respectively into the engine cylinder, said injection nozzle including a main injection passage through which the main fuel is injected to the engine cylinder, a needle valve for opening and closing said main injection passage, an auxiliary injection passage through which the auxiliary fuel is injected to the engine cylinder and which communicates with said main injection passage through said needle valve at a discharge end of the latter, and a check valve for preventing a reverse flow of the main fuel from said main injection passage to said auxiliary injection passage, and said intensifying means including a first intensifier connected to said main injection passage and a second intensifier connected to said auxiliary injection passage, said flow control means including a first flow control pump connected to said first intensifier for feeding the main fuel thereto and a second flow control pump connected to said second intensifier for feeding the auxiliary fuel thereto, said selector means including a first directional control valve connected to said first intensifier and said pressure generating means and controlled by said control means to selectively interconnect said first intensifier and said pressure generating means, and a second directional control valve connected to said second intensifier and said pressure generating means and controlled by said control means to selectively interconnect said second intensifier and said pressure generating means.

2. A multistage fuel injection system according to claim 1, wherein said check valve is disposed within said needle valve.

3. A multistage fuel injection system according to claim 1, wherein said check valve is disposed at said discharge end of said needle valve.

4. A multistage fuel injection system according to claim 1, wherein said needle valve has an axial groove extending therein defining a portion of said auxiliary injection passage; and further comprising an auxiliary valve seat alongside said auxiliary injection passage and thereby operatively aligned with said axial groove, and said check valve has a spring-loaded valve element normally urged against said auxiliary valve seat to close the auxiliary injection passage.

5. A multistage fuel injection system according to claim 4, wherein said spring-loaded valve element is disposed within said axial groove, and said auxiliary valve seat is at an intermediate portion of said axial groove.

6. A multistage fuel injection system according to claim 5, wherein said needle valve includes a separable valve seat element, and said auxiliary valve seat is on said valve seat element.

7. A multistage fuel injection system according to claim 4, wherein said spring-load valve element is disposed outside of said axial groove, and said auxiliary valve seat is on said discharge end of said needle valve.

8. A multistage fuel injection system according to claim 4, wherein said valve element is a poppet.

9. A multistage fuel injection system according to claim 4, wherein said valve element is a ball.

* * * * *